US006052963A

United States Patent [19]

Lefort et al.

[11] Patent Number: 6,052,963

[45] Date of Patent: Apr. 25, 2000

[54] CONTINUOUSLY REINFORCED DIAPHRAGM WALL, METHOD OF CONSTRUCTION AND FORMWORK THEREFOR

[75] Inventors: Philippe Lefort, Brunoy; Jean-Pierre Ganachau, Orgeval; Michel Guerrero, Langon; Jean-Louis Proust, Villemomble; Jean-Claude Gessay, Roissy en Brie; Alain Deniau, Creteil; Olivier Hesse, Bougival, all of France

[73] Assignee: Compagnie Du Sol, France

[21] Appl. No.: 08/981,546

[22] PCT Filed: Apr. 21, 1997

[86] PCT No.: PCT/FR97/00715

§ 371 Date: Dec. 19, 1997

§ 102(e) Date: Dec. 19, 1997

[87] PCT Pub. No.: WO97/40233

PCT Pub. Date: Oct. 30, 1997

[30] Foreign Application Priority Data

Apr. 19, 1996 [FR] France ..... 96 04947

[51] Int. Cl.[7] ..... E04B 1/68; E02D 5/22

[52] U.S. Cl. ..... 52/741.13; 52/127.3; 52/169.9; 52/396.02; 52/742.14; 405/267

[58] Field of Search ..... 52/741.13, 741.15, 52/742.13, 742.14, 395, 396.02, 396.04, 396.05, 127.3, 127.4; 405/266, 267, 284; 249/10, 33, 83, 85; 264/34

[56] References Cited

U.S. PATENT DOCUMENTS

| | | | |
|---|---|---|---|
| 1,193,033 | 8/1916 | Llewllyn . | |
| 2,192,509 | 3/1940 | Simpson | 405/275 X |
| 3,465,532 | 9/1969 | Belden | 249/10 |
| 3,798,914 | 3/1974 | Irwin-Childs | 52/742.15 X |
| 4,453,862 | 6/1984 | Stenne | 52/743.15 X |
| 4,582,453 | 4/1986 | Ressi Di Cervia | 405/267 |
| 4,728,226 | 3/1988 | Ressi Di Cervia | 405/267 |

FOREIGN PATENT DOCUMENTS

| | | |
|---|---|---|
| 0510165 | 6/1980 | Australia . |
| 0066478 | 12/1982 | European Pat. Off. . |
| 0411682 | 2/1991 | European Pat. Off. . |
| 0580926 | 2/1994 | European Pat. Off. . |
| 2148706 | 3/1973 | France . |

*Primary Examiner*—Carl D. Friedman
*Assistant Examiner*—Winnie S. Vip
*Attorney, Agent, or Firm*—Ostrolenk, Faber, Gerb & Soffen, LLP

[57] ABSTRACT

The invention relates to a cast wall constituted by a succession of panels touching via their end edges and made by casting a binder in contiguous lengths of trench dug in the ground in line with one another, each panel including reinforcement, said wall further including link means between the reinforcements in two contiguous panels. The link means (24, 44) are separate from the reinforcement (22, 42) and comprise an anchor element (24) having a first end fitted with at least one vertical first locking element (28, 30) and a second end engaged in one of said panels (22), and a link element (44) having a first end provided with at least a second locking element (46, 48) suitable for co-operating with the first locking element, and a second end engaged in the other one of said panels (42).

5 Claims, 4 Drawing Sheets

CONTINUOUSLY REINFORCED DIAPHRAGM WALL, METHOD OF CONSTRUCTION AND FORMWORK THEREFOR

BACKGROUND OF THE INVENTION

This application is filed under 35 U.S.C. 371 of International Application No. PCT/FR97/00715 filed Apr. 21, 1997.

The present invention relates to a cast wall with continuous reinforcement, to a method of making such a cast wall in the ground, and to shuttering for making such a cast wall.

Cast walls are structures made in the ground by digging a trench and filling the trench with a binder, generally concrete, which sets on site.

The trench can be dug under a slurry which is subsequently replaced by the binder.

To obtain good continuity of the cast wall, the binder must be cast on a single occasion over the full depth of the trench.

To this end, the cast wall is made in the form of successive contiguous panels.

Each panel is obtained by casting the binder into a length of trench that has been dug in line with a solidified panel that has already been made.

The panels are connected together in pairs by their side edges being mutually engaged with a shape that is defined by the shuttering, the engagement also being referred to as an end joint, extending transversely to the trench over the full depth thereof and being put into place prior to casting the binder.

In general, a cast wall is reinforced by reinforcement that is put into place in each length of the trench prior to casting the binder.

Nevertheless, in such a cast wall, the reinforcement is missing at the connections between panels, and as a result such connections constitute zones of weakness in the cast wall, such that the transmission of forces, in particular transverse bending, but also longitudinal compression and traction, does not take place properly from one panel to another, which can give rise to problems in the event of the ground moving, particularly in areas of high seismic activity.

Patent Document FR-A-2 517 717 describes a solution to that problem. It consists in fixing vertical elements of sheet piling to the ends of the panel reinforcement, which elements arc provided with locks that co-operate with one another to provide continuity of the reinforcement from one panel to another.

Nevertheless, that solution does not provide adequate transmission of forces applied to the reinforcement under the effect of external stresses.

In addition, engaging the locks in one another can become difficult when the reinforcing members are not properly aligned.

Finally, the means which are provided for protecting the locks while the casting material is being cast into the trenches are not really satisfactory.

A first object of the invention is to provide a cast wall constituted by a plurality of juxtaposed panels making it possible in particular to obtain a good distribution of the forces applied to the reinforcing members of the various panels, and which is implemented in improved manner.

To this end, the invention provides a cast wall constituted by a succession of panels touching via their end edges and made by casting a binder into contiguous lengths of trench dug in the ground in line with one another, each panel having reinforcement, said wall further including link means between the reinforcement of two contiguous panels, the wall being characterized in that the link means are separate from said reinforcement and comprise an anchor clement having a first end fitted with at least one vertical first locking clement and a second end engaged in one of said panels, and a link clement having a first end fitted with at least one second locking element suitable for co-operating with the first locking clement, and a second end engaged in the other of said panels.

Another object of the invention is to provide a method of making a cast wall, in particular of the above-defined type, and which does not have the drawbacks of the prior art.

To achieve this object, the invention provides a method of making a cast wall in the ground, in particular a wall as defined above, in which method a first length of trench is prepared in which end shuttering is placed and a binder is cast to obtain a first wall panel, and then, at the shuttering end, a second length of trench is prepared contiguous to the first and in line therewith, the shuttering is removed, and a binder is cast into the second length of trench to obtain a second wall panel adjacent to the first, which method is characterized by the fact that, prior to casting the binder in the first length of trench, reinforcement is placed therein together with a link element including locking ends that are positioned in the immediate vicinity of the shuttering, and during casting, said locking ends are prevented from being embedded in the binder so that they project from the first wall panel into the second length of trench after the shuttering has been removed, and prior to casting the binder in the second length of trench, reinforcement is put into place therein together with an anchor element which is secured to the locking ends of the link element, and in that the shuttering is secured to the link element prior to being put into place in the length of trench, the link and anchor elements not being directly secured to the reinforcement, but being engaged therein.

A third object of the invention is to provide shuttering for making a cast wall in a trench, in particular a wall of the type defined above, which shuttering does not have the drawbacks of the prior art.

To achieve this object, the invention provides shuttering for making a cast wall of the above-defined type, which shuttering is designed to be put into place against an end wall of a length of trench dug in the ground to obtain a wall panel by casting a binder into said length of trench, said shuttering including a face for bearing against the end wall of the length of trench, and opposite said bearing face, a casting face looking into the length of trench, the shuttering being characterized by the fact that it includes on its casting face, at least one recess suitable for receiving the locking element of a link element placed in the length of trench, each recess being closed by a vertical wall element provided with a vertical slot suitable for passing a sheet piling element fitted with the locking element and providing sealing between said sheet piling element and the wall of said recess.

BRIEF DESCRIPTION OF THE DRAWINGS

Other characteristics of the invention appear more clearly on reading the following description of various embodiments of the invention given as non-limiting examples. The description refers to the accompanying drawings, in which.

With reference initially to FIGS. 1 to 6, the principle of making a cast wall in accordance with the invention is described.

DETAILED DESCRIPTION OF THE INVENTION

Figure 1:
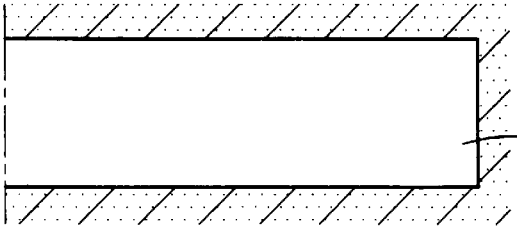
FIGS. 1 to 6 show the principle of the invention by showing the various steps in which two contiguous panels of the cast wall are made.
Figure 2:
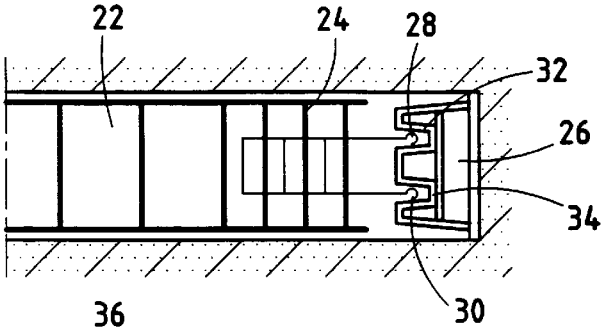

In FIG. 1, there can be seen a length of trench 20 being dug in the ground under a slurry using appropriate apparatus, e.g. a digger bucket.

A metal reinforcement element 22 (described in greater detail below) is put into place in the length of trench, together with a link element 24 secured to a shuttering element 26 that is designed to limit the length of the panel that is to be made. The link element 24 (also described in detail below) is engaged in the reinforcement 22 but is not welded thereto. The term "engaged" is used to mean that a portion of the link element penetrates inside the cage constituted by the reinforcement. The link element 24 is terminated by two locks 28 and 30 which are disposed in two housings 32 and 34 of the shuttering element 26. These housings are closed by means which are described below. The purpose of these means is to prevent the locks being covered by the material constituting the binder (concrete or grout), during casting. In addition, these means temporarily hold together the link element 24 and the shuttering element 26.

Figure 3:
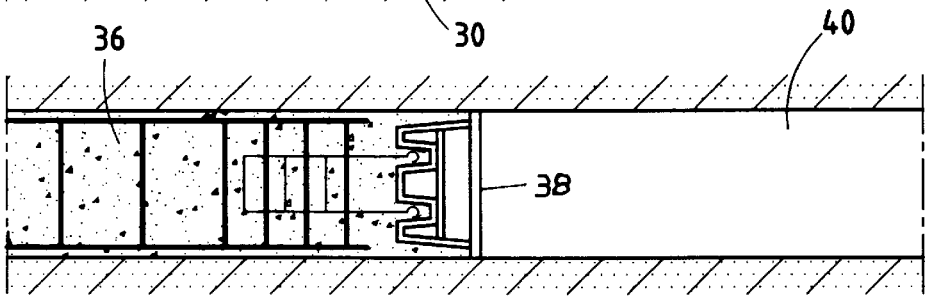
Figure 4:
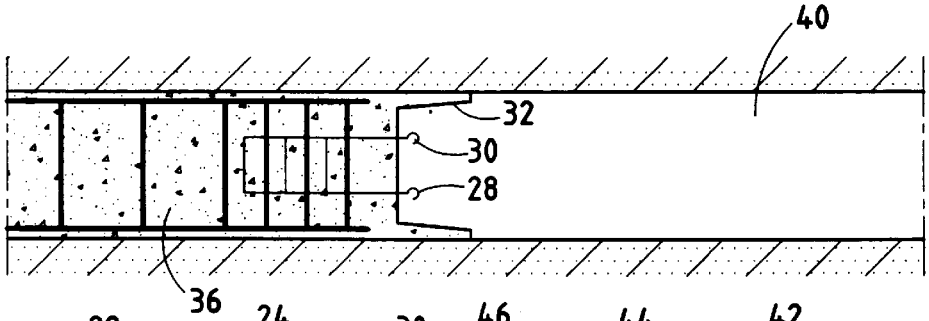
Figure 5:
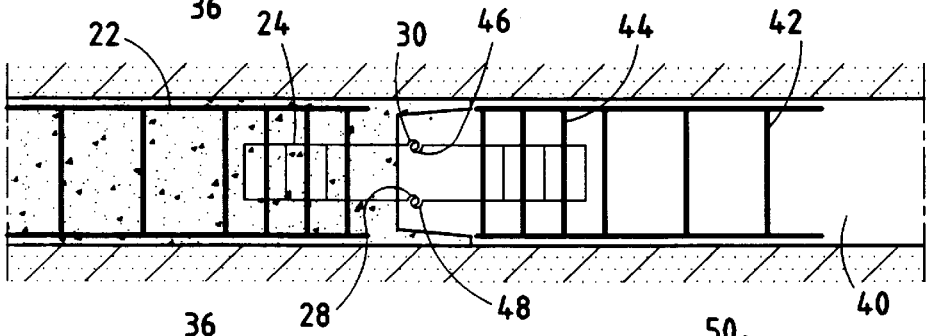
Figure 6:
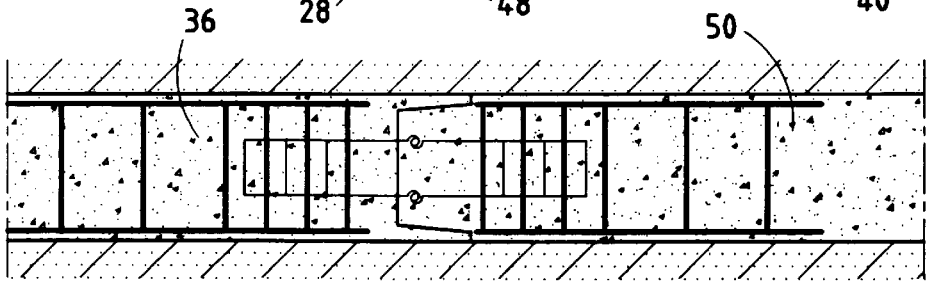

In the following step shown in FIG. 3, the concrete or the grout is cast into the trench 20 to make a panel 36. The panel is reinforced by the reinforcement 22. In addition, it provides mechanical connection between the reinforcement 22 and the link element 24 which are both embedded in the concrete. Nevertheless, because of the housings 32 and 34, the locks 30 and 33 remain free. Also, in conventional manner, the shuttering element 26 is generally U-shaped in horizontal section so that, after the end shuttering 38 of the panel has been removed, the panel 36 is of a shape that is suitable for receiving the following panel. The locks 28 and 30 project into the panel-receiving shape 38.

Prior to removing the shuttering, a second length of trench 40 is dug in which the second panel of cast wall is to be made.

In the length of trench 40, there are put into place simultaneously a piece of metal reinforcement 42 and an anchor element 44, with the anchor element 44 being engaged in the reinforcement 42 but not being welded thereto. While the anchor element 44 is being put into place, its locks 46 and 48 are engaged in the locks 28 and 30 of the link element 24 of the panel 36 that has already been made. This mutual engagement of the locks is greatly facilitated by the fact that since the anchor element 44 is not fixed to the reinforcement 42, the anchor element can be moved horizontally relative to the reinforcement about a vertical midplane of the reinforcement.

Once this operation has been completed, concrete or grout is cast into the length of trench 40 to make a second panel 50 of the cast wall.

It will be understood that because of the hooking between the link elements 24 and the anchor elements 44, continuity of mechanical strength is provided between the metal reinforcement elements of the two panels. Although there is no direct mechanical connection, e.g. by welding, between the reinforcement 22 and 42 and the assembly constituted by the link element 26 and the anchor clement 44, the engagement of said reinforcement elements as embedded in the concrete ensures mechanical continuity.

Figure 7:
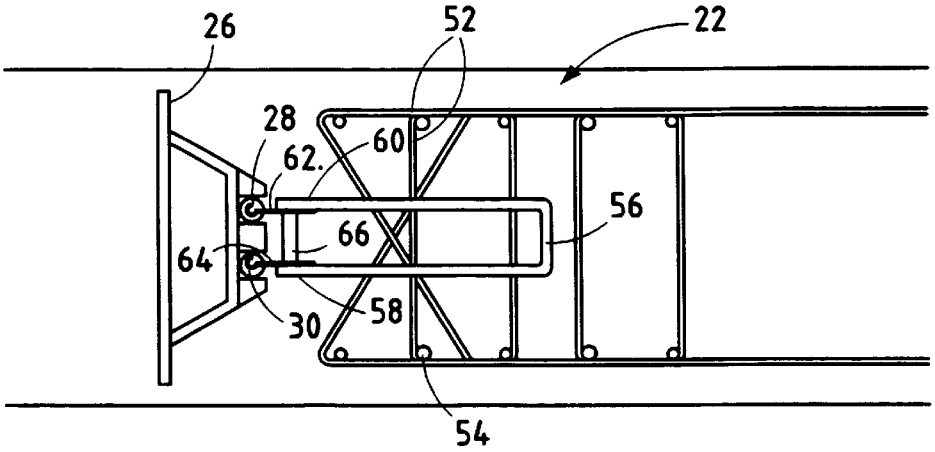
FIGS. 7 and 8 are a plan view and an elevation view of preferred embodiments of reinforcement for a panel and of an anchor element.
Figure 8:
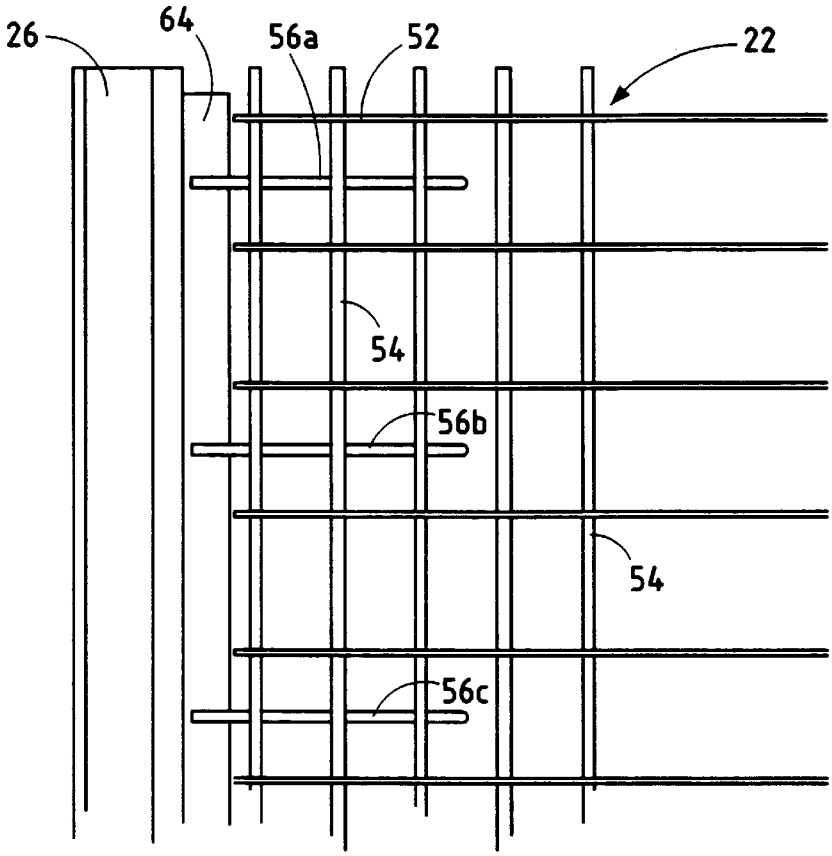

With reference now to FIGS. 7 and 8, a preferred embodiment of the reinforcement 22 and 42, and of the link or anchor elements 24 and 44 is now described.

The reinforcement 22 is constituted in conventional manner by a cage made up of horizontal concrete reinforcing bars 52 and of vertical concrete reinforcing bars 54 that are welded together.

In a preferred embodiment, the link element 24 (or the anchor element 44) is constituted by U-shaped round bars referenced 56. The bars 56 (56*a*, 56*b*, 56*c*) are disposed in horizontal planes that are regularly spaced apart. For example, for reinforcement that is 12 meters high, the bars 56 are spaced about at 66 cm. The free ends 58 and 60 of the branches of the bars 56 are welded to respective sheet piling elements 62 and 64 which are terminated by locks 28 and 30 (or 46 and 48). Optionally flat horizontal bars 66 can be welded at regular intervals between the sheet piling elements 62 and 64.

It will be understood that the link elements or anchor elements are essentially constituted by horizontal U-shaped round bars secured to one another by the sheet piling. The U-shaped bars are engaged in the bars forming the reinforcement, but they are not secured thereto.

It would not go beyond the ambit of the invention if the link elements or anchor elements were made in some other way. Nevertheless, it is important for them to be essentially constituted by concrete bars that are horizontal in order to facilitate horizontal transmission of forces that are liable to be applied to the panels, and thus to their reinforcement.

Also naturally, the locking elements for locking the anchor elements and the link elements could be constituted by members other than sheet piling type locks. It suffices for them to be male and female locking members suitable for co-operating with one another when a piece of reinforcement is put into place in a length of trench.

Figure 9:
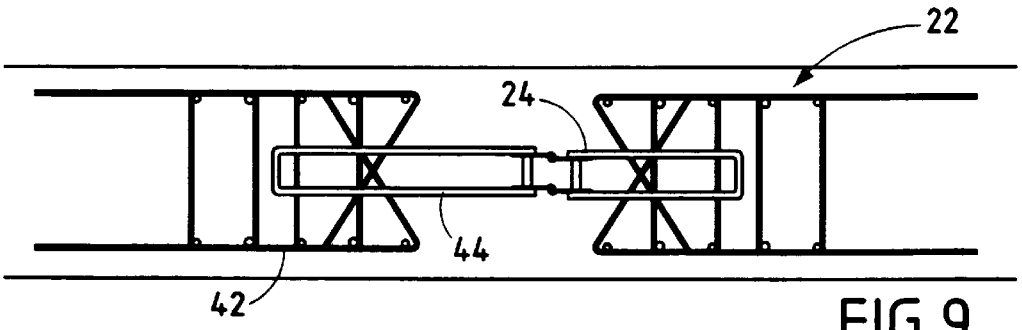
FIG. 9 shows the connection between the reinforcement of two is panels of the cast wall.

FIG. 9 is a plan view of the locking between a link element 24 and an anchor element 44, with the concrete omitted to facilitate understanding.

In FIG. 7, there can also be seen the shuttering element 26 with its two housings 32 and 34 in which the locks 28 and 30 are "enclosed". The preferred embodiment of the shuttering element 26 is described below with reference to FIGS. 10 and 11.

Figure 10:
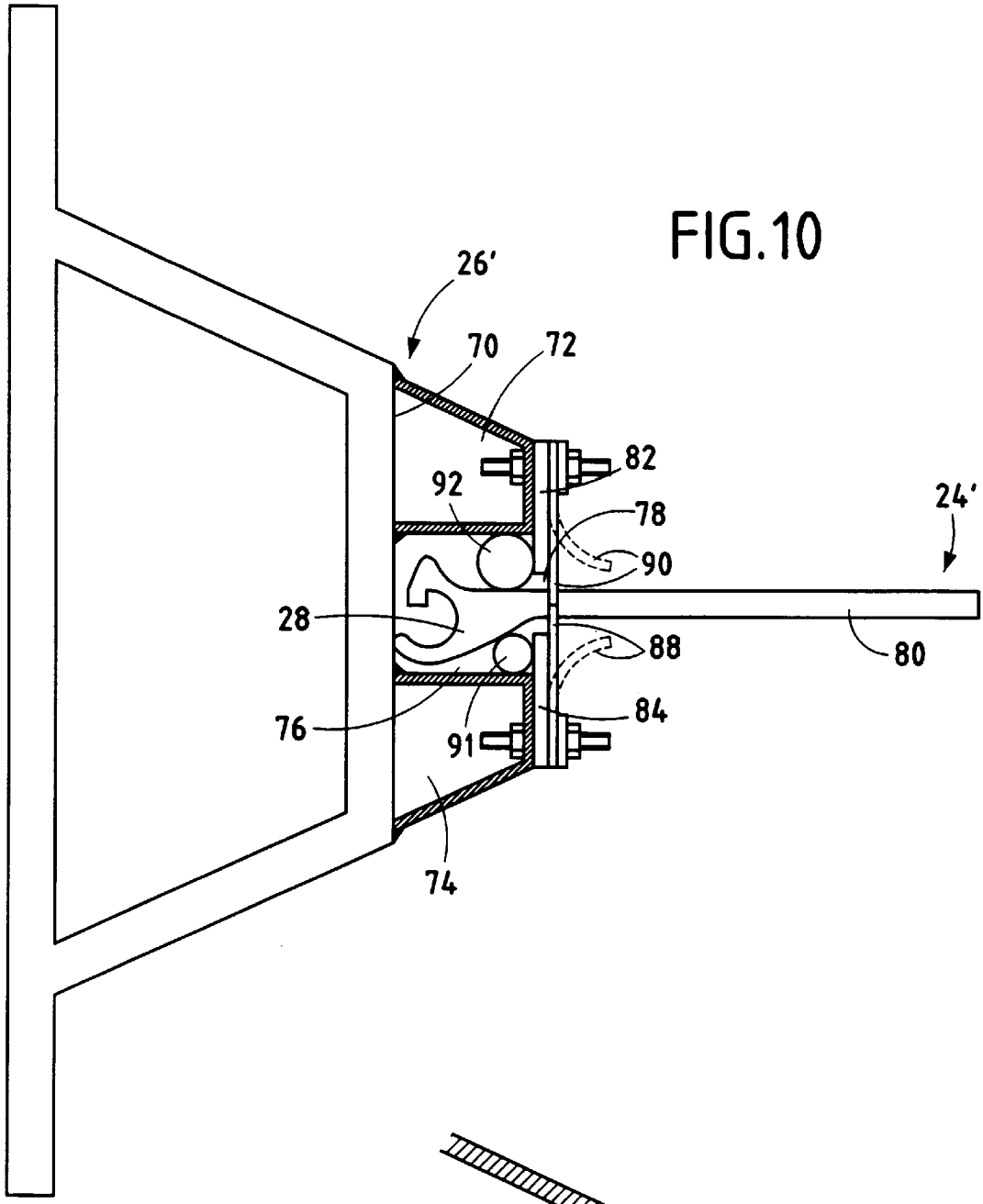
FIG. 10 is a vertical section through a preferred embodiment of the shuttering when there is only one lock.
Figure 11:
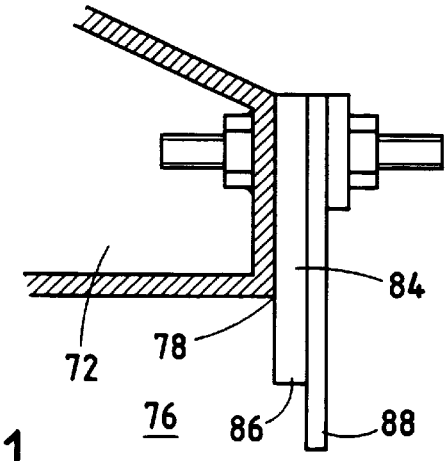
FIG. 11 is a detail view of FIG. 10.

In FIG. 10, there can be seen a shuttering element 26' for a link element 24' that has only one lock 28.

The shuttering 26' proper is provided on its molding face 70 with two metal parts 72 and 74 which define a housing or recess 76 between them having an opening 78. The dimensions of the housing 76 are sufficient to receive the lock 28 disposed at the end of the vertical sheet piling element 80. The opening 78 is closed by two rigid wall portions 82 and 84 which leave between them a slot 86 of width slightly greater than the width of the sheet piling 80, with the wall portions 82 and 84 being fixed to the parts 72 and 74. The slot 86 is closed by flexible sealing lips 88 and 90 fixed on the walls 82 and 84. These lips 88 and 90 bear by resilient deformation on the faces of the sheet piling 80, thus providing sealing against the binder.

The rigid walls 82 and 84 position the link element 24 horizontally and secure the shuttering 26 temporarily on the clement 24.

To further improve sealing, two vertical flexible hoses 91 and 92 can be mounted inside the housing 76 in contact with the lock, the wall portions 82 and 84, and the inside wall of the housing. This provides a double sealing system.

These hoses can also be used to establish a flow of water for "cleaning" the locks, after the grout or concrete has been cast, supposing a small quantity thereof has managed to penetrate into the housing.

Figure 12:
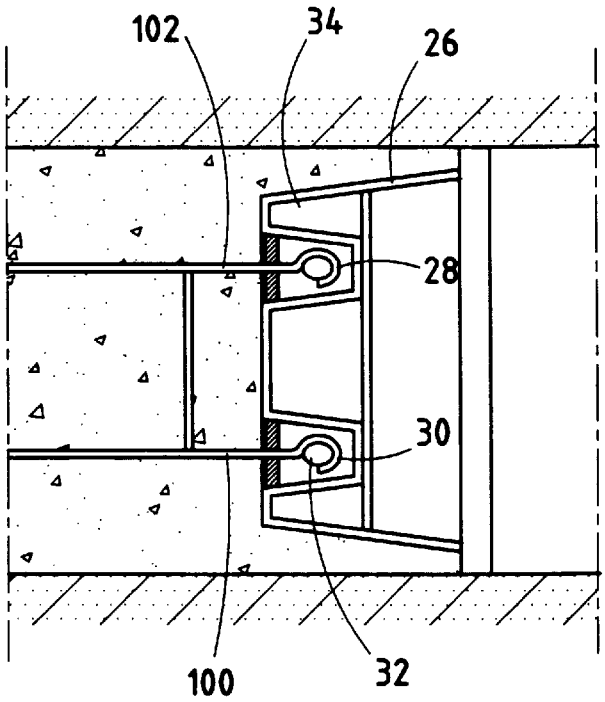
FIGS. 12 and 13 are section views seen vertically of variant embodiments of the shuttering.
Figure 13:
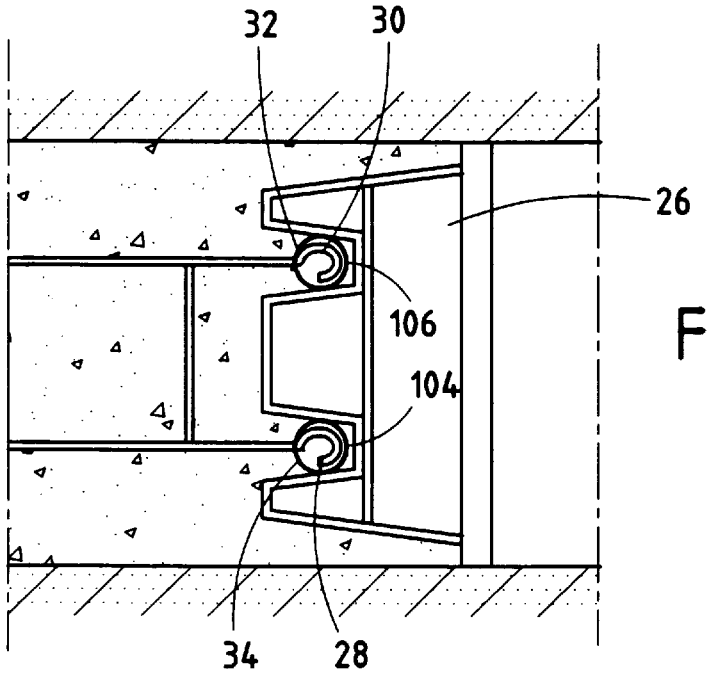

FIGS. 12 and 13 show variant embodiments of the means serving for sealing the housing(s) formed in the shuttering element.

In the embodiment of FIG. 12, the locks 28 and 30 are protected in the housings 32 and 34 by rubber covers 100 and 102.

In the embodiment of FIG. 13, the locks 28 and 30 are protected by split tubes 104 and 106 which are threaded over the locks. Even if a coating of binder does form around the tubes 104 and 106 after the shuttering 26 has been removed, these coatings are easily destroyed by the locks of the next element of sheet piling being put into place.

What is claimed is:

1. A cast wall comprising a succession of panels having end edges and touching via said edges and made by casting a binder into contiguous lengths of trench dug in the ground in line with one another, each panel having reinforcement with an end portion thereof, said wall further including link means between the reinforcement of two contiguous panels, said link means being separate from said reinforcement and comprising an anchor element in one of said panels and a link element in other one of the panels, each anchor element and each link element comprises a plurality of bars disposed substantially in horizontal planes, the free ends of the bars being secured to a vertical lock-forming sheet piling type element, at least a portion of the bars being separably engaged without direct mechanical linking in the end portion of the reinforcement of the panel, and the lock-forming sheet piling type element of the anchor element cooperating with the lock-forming sheet piling type element of the link element.

2. A cast wall according to claim 1, wherein said bars are U-shaped round bars having two limbs disposed in horizontal planes, and a curved portion, at least one limb of each U-shaped bar being secured to said lock-forming sheet piling element, at least the curved portion of the U-shaped round bar being engaged in the end of the reinforcement of the panel without being directly mechanically linked.

3. A method of making a cast wall in the ground in which a first length of trench is prepared in which end shuttering is placed and a binder is cast to obtain a first wall panel, and then, at the shuttering end, a second length of trench is prepared contiguous to the first and in line therewith, the shuttering is removed, and a binder is cast into the second length of trench to obtain a second wall panel adjacent to the first, and prior to casting the vinder in the first length of trench, reinforcement is placed therein together with a link element including locking ends that are positioned in the immediate vicinity of the shuttering, and during casting, said locking ends are prevented from being embedded in the binder so that they project from the first wall panel into the second length of the trench after the shuttering has been removed, and prior to casting the binder in the second length of trench, reinforcement is put into place therein together with an anchor element which is secured to the locking ends of the link element, and in that the shuttering is secured to the link element prior to being put into place in the length of the trench, the link and anchor elements not being directly secured to the reinforcement, but being engaged therein, and further wherein each anchor element and each link element comprises a plurality of bars disposed substantially in horizontal planes, the free ends of the bars being secured to a lock-forming sheet piling type element, at least a portion of the bars being engaged without direct mechanical linking in the end portion of the reinforcement of the panel.

4. A cast wall comprising a succession of panels having end edges and touching via said edges and made by casting a binder into contiguous lengths of trench dug in the ground in line with one another, each panel having reinforcement, said wall further including link means between the reinforcement of two contiguous panels, said link means being separate from said reinforcement and comprising an anchor element having a first end fitted with at least one first vertical locking element and a second end separably engaged in the reinforcement of one of said panels, and a link element having a first end fitted with at least one second locking element and cooperating with the first locking element, and a second end separably engaged in the reinforcement of the other of said panels, and wherein each anchor element and each link element is undeformable.

5. Shuttering for making a cast wall and designed to be put in place against an end wall of a length of trench dug in the ground to obtain a wall panel by casting a binder into said length of trench, said shutting including a face for bearing against the end wall of the length of trench, and opposite said bearing face, a casting face looking into the length of trench, the shuttering further including on its casting face, at least one recess suitable for receiving a locking element of a link element placed in the length of trench, each recess having walls and being closed by a vertical wall element including two vertical wall portions secured to said walls of said recess and leaving between them a vertical slot for passing a sheet piling element fitted with the locking element, said vertical wall portions having inside faces, two resilient sealing elements respectively secured to said vertical wall portions, said sealing elements extending into said vertical slot and forming sealing lips for pressing against the faces of said sheet piling element and two portions of vertical flexible hose disposed in said recess, each hose portion being in contact with the wall of said recess, the inside face of the vertical wall portion, and one face of the locking element.

* * * * *